United States Patent [19]

Blaser

[11] Patent Number: 5,063,699

[45] Date of Patent: Nov. 12, 1991

[54] BREAK-OPEN FIREARM WITH READILY EXCHANGEABLE FIRING PIN

[76] Inventor: Horst Blaser, Ziegelstadel 324, 7972 Isny im Allgäu, Fed. Rep. of Germany

[21] Appl. No.: 640,872

[22] Filed: Jan. 14, 1991

[30] Foreign Application Priority Data

Jan. 13, 1990 [DE] Fed. Rep. of Germany ..... 4000818

[51] Int. Cl.[5] ..... F41A 3/00

[52] U.S. Cl. ..... 42/41; 42/45

[58] Field of Search ..... 42/41, 42.01, 42.02, 42/42.03, 43, 44, 45

[56] References Cited

U.S. PATENT DOCUMENTS 2,092,850 9/1937 Neubrand ..... 42/42.02

2,376,358 5/1945 Horsrud ..... 42/43

FOREIGN PATENT DOCUMENTS 1436 of 1869 United Kingdom ..... 42/41

4440 of 1910 United Kingdom ..... 42/41

*Primary Examiner*—Richard W. Wendtland

*Attorney, Agent, or Firm*—Antonelli, Terry, Stout & Kraus

[57] ABSTRACT

A firing pin exhibiting a notch or annular groove laterally engaged by a stud whereby the axial path of the firing pin is limited, can be simply and quickly disassembled and assembled, if the stud can be removed and inserted without complications. It is furthermore advantageous to omit retractor springs at the firing pins and to effect, instead, the retraction of the firing pins during loading and unloading (breaking open) of the barrel or barrels by means of a retractor plate in conjunction with the breechblock lever.

9 Claims, 1 Drawing Sheet

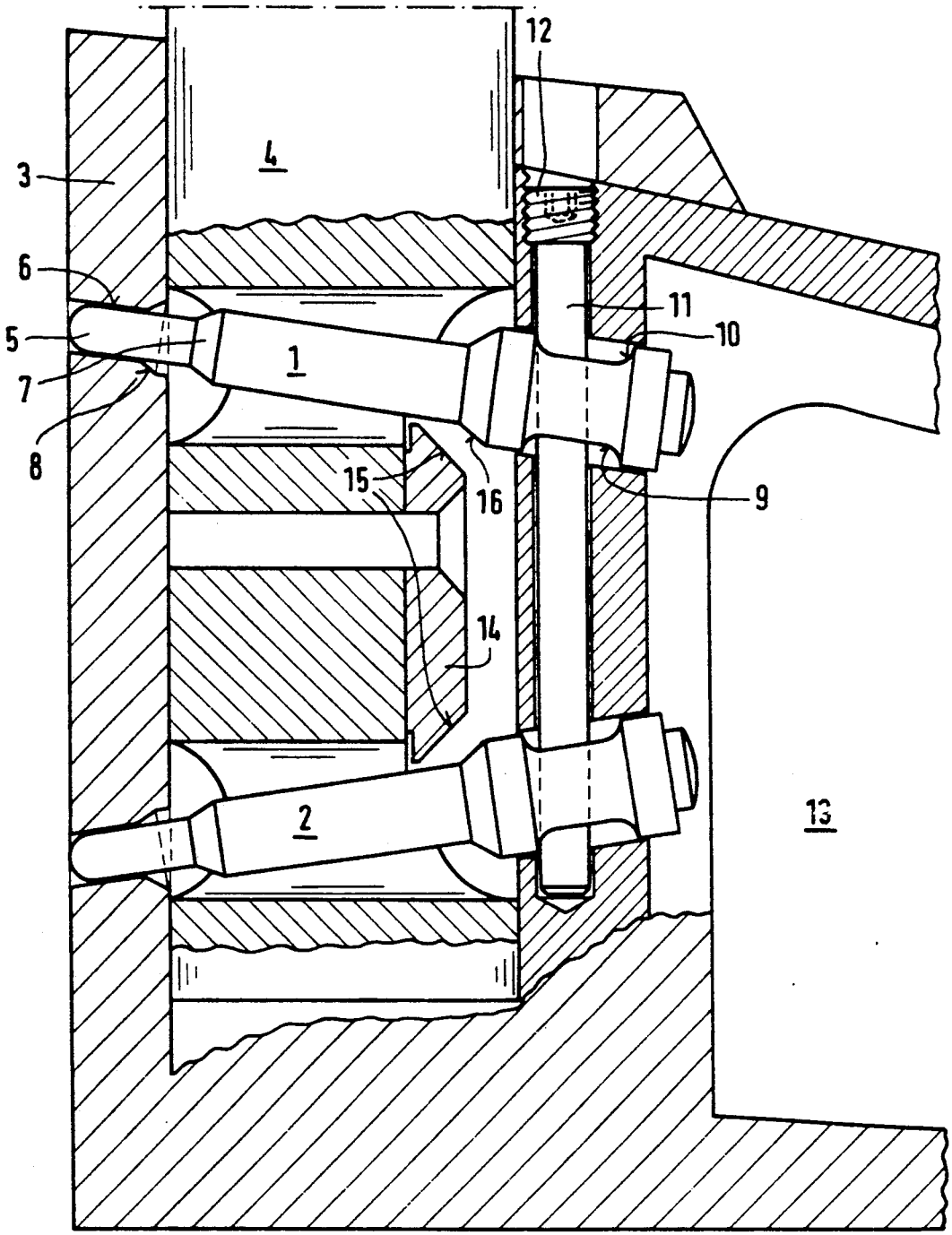
12
4
3
6
5
7
8
1
11
10
15
16
9
14
2
13

BREAK-OPEN FIREARM WITH READILY EXCHANGEABLE FIRING PIN

BACKGROUND OF THE INVENTION

This invention concerns a break-open firearm with at least one barrel, a breech housing with removable lock, each barrel being associated with a firing pin guided in the breech housing, and a device by means of which the tip of each firing pin is retracted into the breech housing during the opening or closing of the barrel.

Such a sport or hunting rifle has been known from DOS 2,619,855 or DE 3,640,606 Cl.

Breakage of a firing pin is one of the most frequently occurring disturbances in such firearms. The firing pin is stressed approximately axially by a striker, and the tip of the firing pin is pushed into a primer cap. In a break-open firearm, a device is furthermore provided which retracts the tip of the firing pin, which latter must protrude from the breech housing for igniting the cartridge, when the barrel is broken open for loading or unloading purposes. Normally, this step is performed by a spring at the firing pin retaining the firing pin in a rearward position. Such a spring makes it additionally difficult to exchange a firing pin. A voluminous collection of tools is required for exchanging a firing pin, accompanied by a partial disassembly of the firearm. A firing pin spring that is broken or that is lost during disassembly is a contributory annoyance.

SUMMARY OF THE INVENTION

The invention is based on the object of designing the firing pin and its guidance so that exchanging of a firing pin can be executed in a simple way.

This object has been attained by a break-open firearm of the type heretofore discussed by providing that each firing pin exhibits a notch, a stud guided in the breech housing engaging into the notch in such a way that the firing pin, with the stud inserted, cannot be removed from the breech housing; that the notch has such a width that the necessary movement of the firing pin in the breech housing is not impeded by the stud; and that the stud can be dismounted from and mounted in the breech housing in a simple manner.

Each of the firing pins are guided in the breech housing. The stud, in conjunction with the notch, restricts the axial movement of the firing pins. In case the stud, preferably designed as a stud bolt, is removed from the breech housing, the firing pins can be "shaken out" through the breech well. By means of a pair of tweezers, the firing pins can be reinserted without any difficulties. For the removal and/or reinsertion of the stud, the only tool that may be required is a socket wrench.

Preferably, the firing pins are rotationally symmetrical; the notches at the firing pins are fashioned as annular grooves. The stops on the sides of the notch and/or groove, limiting the path of the firing pin, should exhibit rounded corners and should be adapted to the profile of the stud. In addition, the firing pin can also exhibit still additional surfaces, opposed by corresponding edges and surface areas at the breech housing whereby a further restriction of the firing pin route in the direction toward the cartridge can be provided.

The stud, based on the firing pins, should be mountable in a plane to the right and to the left thereof so that the same simple accessibility to the stud is afforded to right- and lift-handed shooters.

A preferred device for retracting the tip of the firing pin during loading and/or unloading exhibits a retractor plate on the breechblock lever shaft. The retractor plate includes beveled portions corresponding to beveled areas at the firing pins.

Preferably, the path of the firing pin is restricted not solely by the form of the notch at the firing pin, but also additionally by a stop in the breech housing.

BRIEF DESCRIPTION OF THE DRAWINGS

The invention is illustrated by way of example in the drawing and will be further described below. The FIGURE shows the region of the breech housing with two superimposed barrels in the plane of the firing pins, this plane here being identical with the plane of symmetry of the rifle.

DETAILED DESCRIPTION OF THE INVENTION

The two identical, rotationally symmetrical firing pins 1, 2 are guided in the breech housing 3 at two locations. The central zone of the breechblock lever shaft 4 (the axis of which extends in the plane of the drawing) is drilled open to such an extent that the axial movement of the firing pins 1, 2 is not impeded thereby.

The shape, the guidance, and the path restriction of the firing pins 1, 2 are characteristic. A relatively slender tip 5 slides within a bore 6 in the breech housing 3; also the rearward portion of the firing pins 1, 2, is guided. The forward region of the firing pins 1, 2 exhibits an annular shoulder 7 serving, in conjunction with a stop 8 at the breech housing 3, for path limitation. In their rearward zone, the firing pins 1, 2 exhibit a notch 9 which can also be considered to be an annular groove, the corners 10 being advantageously rounded. The size of the notch 9 limits the path of the firing pins 1, 2 and is adapted to a stud 11 guided in the breech housing 3 in a manner somewhat offset with respect to the plane of the firing pins 1, 2. The stud 11 extends approximately perpendicularly to the firing pins 1, 2. The stud can be mounted to the right or to the left of the plane of the firing pins. In case of a rifle, these two guide means for the stud 11 should always be provided in the breech housing 3 because in this way the advantageous disassembly of the firing pins is possible in all cases, independently of the direction into which the breechblock lever is turned, i.e., whether the firearm is handled by a right-handed or left-handed person. (The head 12 of the stud 11 is thereby always accessible with the breechblock lever being open.) The edges of the notch or annular groove 9 limit the movements of the firing pins 1, 2 with the stud 11 being inserted. However, once the stud 11 has been pulled out, the firing pins 1, 2 can be readily shaken out into the space 13 accommodating the breech, and, alternatively, can also be readily inserted from this location.

Since, during loading and unloading of the firearm, i.e., during the breaking open of the barrel, the firing pins must always be retracted, a retractor plate 14 is here provided at the breechblock lever shaft 4, in place of retractor springs; as a consequence, during pivoting of the breechblock lever shaft 4 by about 30°, the beveled surface 15 at the retractor plate 14 is urged against a shoulder 16 at the firing pins 1, 2 and thus the firing pins are shifted into the retracted position. Since experience has shown that, besides the firing pin, also retractor springs are frequently broken and insertion of a spring at the location within the assembly is cumbersome and often annoying, the described structure of the firing pins, in conjunction with a stud and the guidance and/or retraction of the firing pins in the breech housing, quite decisively defuses the main sources of trouble; if a firing pin should break, after all, then its exchange will present hardly any difficulties.

I claim:

1. A break-open firearm with at least one barrel, a breech housing with removable lock, each barrel being associated with a firing pin guided in the breech housing, and a device by means of which the tips of the firing pins are retracted into the breech housing during the opening or closing of the barrel, characterized in that each firing pin has a notch, a stud guided in the breech housing engaging into the notch in such a way that each firing pin, with the stud inserted, cannot be removed from the breech housing; that the notch has such a width that the necessary movement of each firing pin in the breech housing is not impeded by the stud; and that the stud can be dismounted from and mounted in the breech housing in a simple way.

2. A break-open firearm according to claim 1, characterized in that each firing pin is rotationally symmetrical.

3. A break-open firearm according to claim 1 or claim 2, characterized in that the notch is designed as a annular groove.

4. A break-open firearm according to claim 1 or claim 2, characterized in that the stud is designed as a stud bolt.

5. A break-open firearm according to claim 1 or claim 2, characterized in that the firearm has two barrels, the stud, based on the firing pins, can be mounted in a plane to the right or to the left of the firing pins in case of superimposed barrels and, respectively above or below the firing pins in case of barrels disposed side-by-side.

6. A break-open firearm according to claim 1, characterized in that the firearm has two barrels and the device for retracting the tips of the firing pin comprises a retractor plate mounted to the breechblock lever shaft.

7. A break-open firearm according to claim 6, characterized in that the retractor plate has beveled portions corresponding to beveled portions on the firing pins.

8. A break-open firearm according to claim 1, characterized in that the notch has rounded corners.

9. A break-open firearm according to claim 1, characterized in that surfaces are provided in the breech housing effecting an additional path restriction of each firing pin.

* * * * *